United States Patent [19]

Beirnes

[11] Patent Number: 4,712,330

[45] Date of Patent: Dec. 15, 1987

[54] WEATHERSTRIPPING FOR SIDE-HINGED WINDOWS AND DOORS

[76] Inventor: James R. Beirnes, P.O. Box 2099, Joliet, Ill. 60434

[21] Appl. No.: 890,506

[22] Filed: Jul. 30, 1986

[51] Int. Cl.[4] ..... E06B 7/16

[52] U.S. Cl. ..... 49/484; 49/485; 49/489

[58] Field of Search ..... 49/485, 489, 484

[56] References Cited

U.S. PATENT DOCUMENTS

| | | | |
|---|---|---|---|
| 3,177,924 | 4/1965 | McPhail | 49/484 X |
| 3,404,487 | 10/1968 | Johnson | 49/489 X |
| 3,819,444 | 6/1974 | Ungerer | 49/489 X |
| 4,064,654 | 12/1977 | Olson | 49/489 |
| 4,148,953 | 4/1979 | Horton | 49/489 X |
| 4,198,453 | 4/1980 | Olson | 49/489 X |
| 4,214,930 | 7/1980 | Burrous | 49/489 X |
| 4,288,483 | 9/1981 | Miska et al. | 49/489 X |
| 4,313,990 | 2/1982 | Franklin et al. | 49/489 X |
| 4,372,629 | 2/1983 | Propst et al. | 49/489 X |
| 4,458,450 | 7/1984 | Young et al. | 49/489 |

FOREIGN PATENT DOCUMENTS

| | | | |
|---|---|---|---|
| 2026067 | 1/1980 | United Kingdom | 49/484 |

*Primary Examiner*—Philip C. Kannan

*Attorney, Agent, or Firm*—John L. Parker

[57] ABSTRACT

A planar window or door and frame is provided having the window or door hinged at one side to the frame so that the window or door swings outwardly and inwardly in relation to the frame, and having the top of the window or door spaced slightly beneath the adjacent portion of the frame to permit relative swinging movement between window and frame. A continuous row of resilient fibers is mounted on the frame adjacent the top of the window or door so that it covers the space between the top of the window or door and the adjacent portion of the frame when the window is closed. This row of resilient fibers extends across the width of the window or door so that as the window or door swings to open or closed positions the row of fibers deforms incrementally along the moving juncture between the top of the window or door and the frame to thereby provide a continuous seal against rainwater and wind leakage between the window or door top and the frame. The resilient row of fibers is disclosed extending downwardly from the frame a distance greater than the space between the top of the window and the frame. Also, the resilient row of fibers is horizontally spaced outwardly from the window when closed a distance about equal to or greater than the distance that the row of fibers extends downwardly from the frame.

1 Claim, 17 Drawing Figures

WEATHERSTRIPPING FOR SIDE-HINGED WINDOWS AND DOORS

BACKGROUND AND OBJECTS OF THE INVENTION

This invention relates to the weatherstripping of side-hinged windows and doors. More particularly, the invention relates to provision of weatherstripping between the top surface of a side-hinged window (casement window) or door and its adjacent window or door frame.

The primary region of leakage or penetration of rainwater and wind around a casement window tends to be along the top of the window, through the space between the window top and the adjacent window frame. Typically, a small space or gap of perhaps ⅛ inch is provided around the periphery of the window between the window and the window frame to accommodate swinging motion of the window with respect to the frame. Thus, a gap of this type typically exists along the top of the window between its top surface and the undersurface of the frame head jamb. The sealing or weatherstripping of this gap from rainwater and wind leakage is particularly difficult because during swinging open or closing of the window, the swinging motion tends to create a continuous series of points of possible leakage along the top of the window at the juncture between the window and frame.

To understand how this occurs, it may be visualized that when a casement window is in the closed position, the window is generally aligned so as to occupy the same plane as the frame. When the window is opened by being swung outwardly, the window "breaks" this plane and in so doing creates a region of possible leakage along the top of the window at the juncture between the window and frame. Thus, if the window is partially open, for example, the window is disposed angularly with respect to the plane of the frame which results in a point of juncture between the top of the window and the frame. This juncture point, which continuously moves along the width of the window as it is swung open or closed, constitutes a region vulnerable to leakage of rainwater. Any conventional weatherstripping provided in an attempt to seal the top of the window will tend to become unevenly distorted at the juncture point resulting in the opportunity for leakage to occur.

To assist in visualizing this situation, consider that when a casement window is half-open, the portion of the window nearest the hinge may more or less maintain contact with any conventional weatherstripping provided between the window top and the frame to thereby provide a weather seal over this half of the window. The other half or outer portion of the window will not be in contact with the weatherstripping and will gradually come into contact with such weatherstripping only as the window swings to assume a completely closed position. But as the window swings, a gradual depression or distortion of the conventional weatherstripping is encountered at the point of juncture between the top of the window and the frame thus creating opportunities for leakage of rainwater or wind to take place at this moving point of engagement between the window and the weatherstripping.

Accordingly, it is a principal object of the present invention to provide weatherstripping for a side-hinged window or door which is capable of accommodating the swinging motion of the window or door, and yet which minimizes and prevents leakage along the juncture between the top of the window or door and the adjacent frame. A related object is to provide specially shaped and constructed weatherstripping along the top of a casement window (or a side-hinged door), which weatherstripping is capable of incrementally deforming to adapt to the configuration of the window (or door) as it swings into place within its frame.

Another object of the invention is to provide weatherstripping for a side-hinged window or door which provides an effective seal against rainwater and wind leakage along the top of the window or door especially during its opening or closing. Still another object of the invention is to provide such weatherstripping which may be included as a main feature of newly constructed side-hinged windows and doors, or may be retrofitted to existing windows and doors.

Certain preferred structures in accordance with the invention have been described and illustrated. It will be apparent to those skilled in the art that various changes and modifications may be made therein within the spirit and scope of the invention. It is intended that such changes and modifications be included within the scope of the appended claims.

BRIEF DESCRIPTION OF THE DRAWINGS

The foregoing and other objects, advantages and functions of the invention will be apparent on reference to the specification and to the attached drawings illustrating a preferred embodiment of the invention, in which drawings like reference symbols are applied to like parts in each of the views, and in which:

FIG. 7 shows a spaced vertical relationship, x, between the top of the window and the frame, the exposed length, y, of the illustrative weatherstripping, and a spaced horizontal relationship, z, between the weatherstripping and the window when the window is closed.

DESCRIPTION OF THE PREFERRED EMBODIMENT

Figure 1:
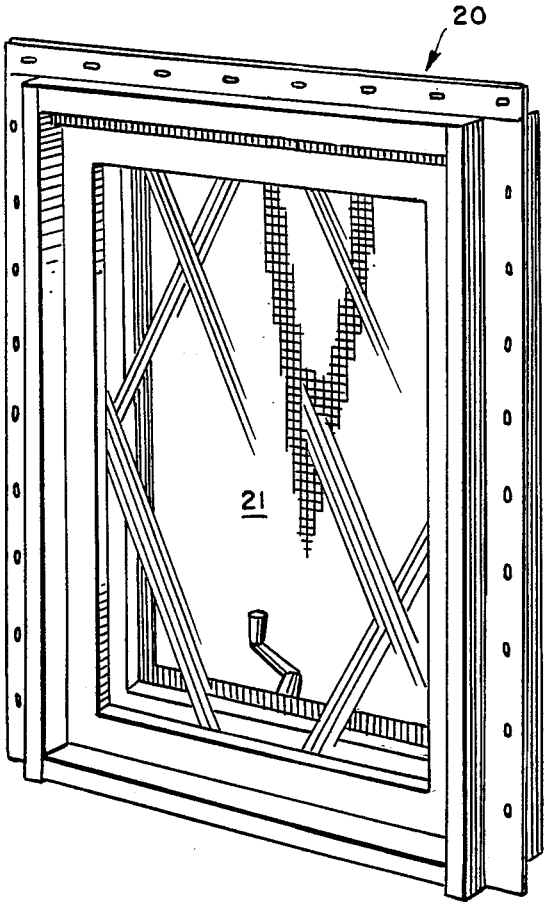
FIG. 1 is a front perspective view of an illustrative casement window and window frame incorporating the features of the present invention, showing the window in closed position.

Turning now to the drawings, a preferred embodiment of the invention is illustrated in conjunction with a window frame 20 for installation in a building wall (not shown), and in which a casement window 21 is mounted. The illustrative window frame 20 includes a horizontal head member or head jamb 22, a pair of spaced parallel vertical side jambs 24 at opposite ends of the head jamb, and a bottom sill 25 extending horizontally between the lower ends of the side jambs. As shown, the frame is formed of extruded aluminum. The head jamb 22, side jambs 24, and sill 25 define a generally rectangular window opening leading to the interior of the building, such as a dwelling.

Figure 2:
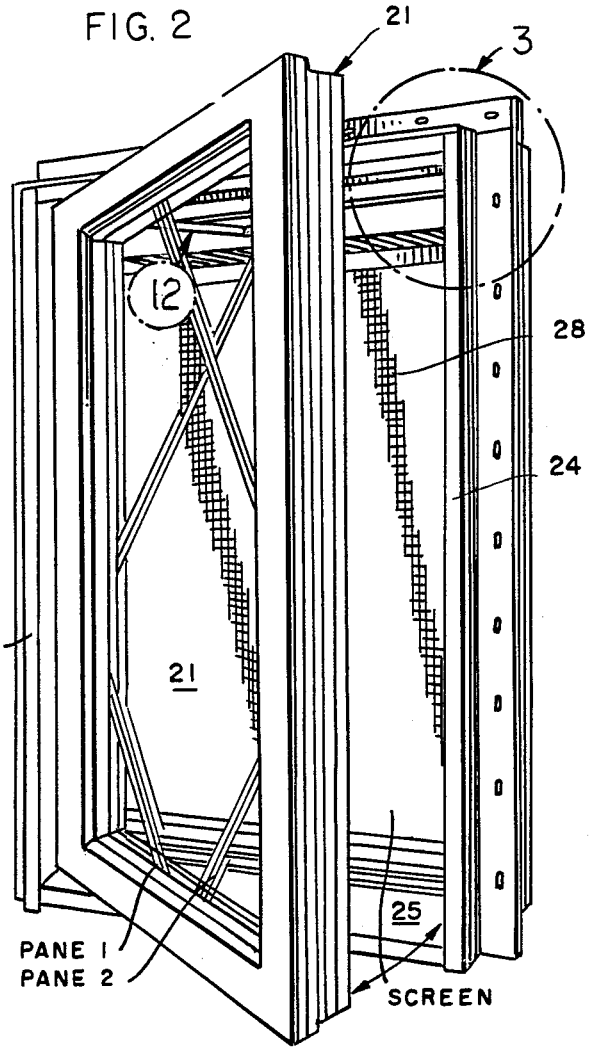
FIG. 2 is a front perspective view of the casement window and frame shown in FIG. 1, but showing the window in partially open position.

As illustrated, the window 21 (double pane as shown here) is secured to the frame on the left side as viewed in FIGS. 1 and 2 by means of conventional upper and lower hinges 26. A rabbet 26*a* provided in the head jamb 22 provides space between the top of the window and the head jamb to accommodate the upper window hinge 26 (see FIGS. 3, 12). The window 21 may be manually opened and closed by a hand crank arrangement 27 located at the lower portion of the window. A conventional window screen 28, separate from the window 21, is shown installed within the frame 20 between the window and the frame. Conventional tubular weatherstripping 29 may be employed for sealing the back of the window against the frame when the window is in the closed position.

Typically, a small space or gap is provided between the top surface 21*a* of the window and the undersurface 22*a* of the head jamb (see x in FIG. 7) in order to accomodate freedom of swinging movement of the window from closed to open back to closed positions. This space may, for example, be about ⅛ inch. As explained above, it is this space, necessary for structural and dynamic reasons, which poses the most serious window leakage problems.

Figure 15:
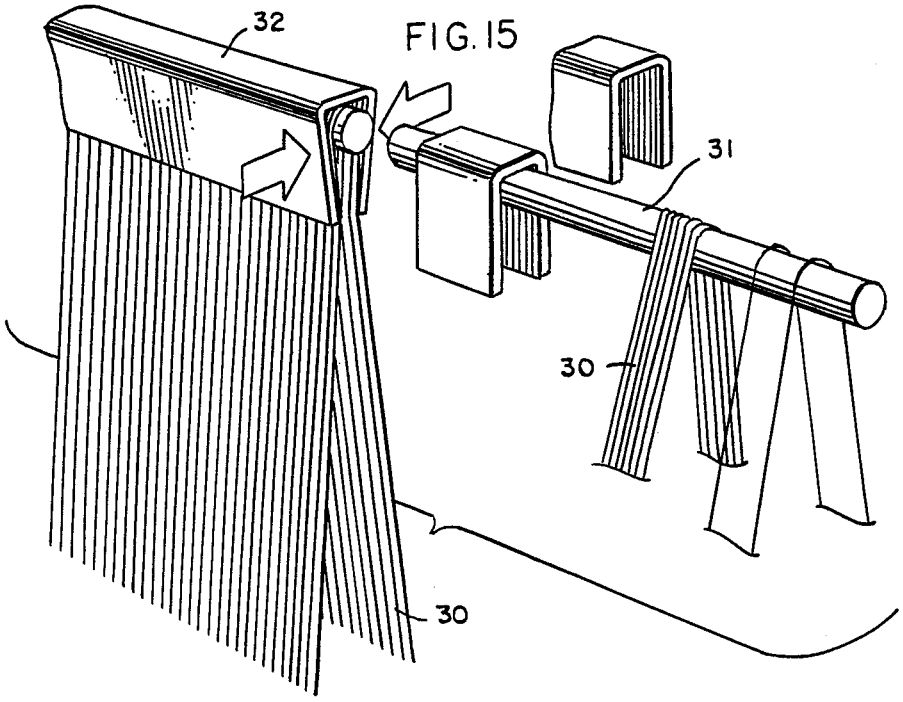
FIG. 15 is a fragmentary, perspective view, partially exploded, showing various component parts of the illustrative weatherstripping and the manner in which they are assembled together.

In carrying out the invention, a continuous row 30 of resilient fibers is mounted on the frame head jamb 22 adjacent the top of the window and arranged so as to cover the space x between the top of the window and the frame. As shown, the row 30 of fibers is brush-like in appearance, comprising a pile of fibers or bristles each of which is flexible and resilient. The individual fibers are thus thin and easily deformable or collapsible. As shown in the drawings (especially see FIG. 15), the row of fibers is formed by wrapping individual strands around a rod 31 which is then placed within a U-shaped channel member 32 which is pinched so as to tightly grip the fibers. As a result, the brush-like row 30 of fibers extends outwardly from a pinched channel or backing strip 32 having a wedge shaped cross-section. The channel or backing strip 32 may be formed of metal or plastic, and the fibers may be made of various known natural or artificial materials.

Figure 3:
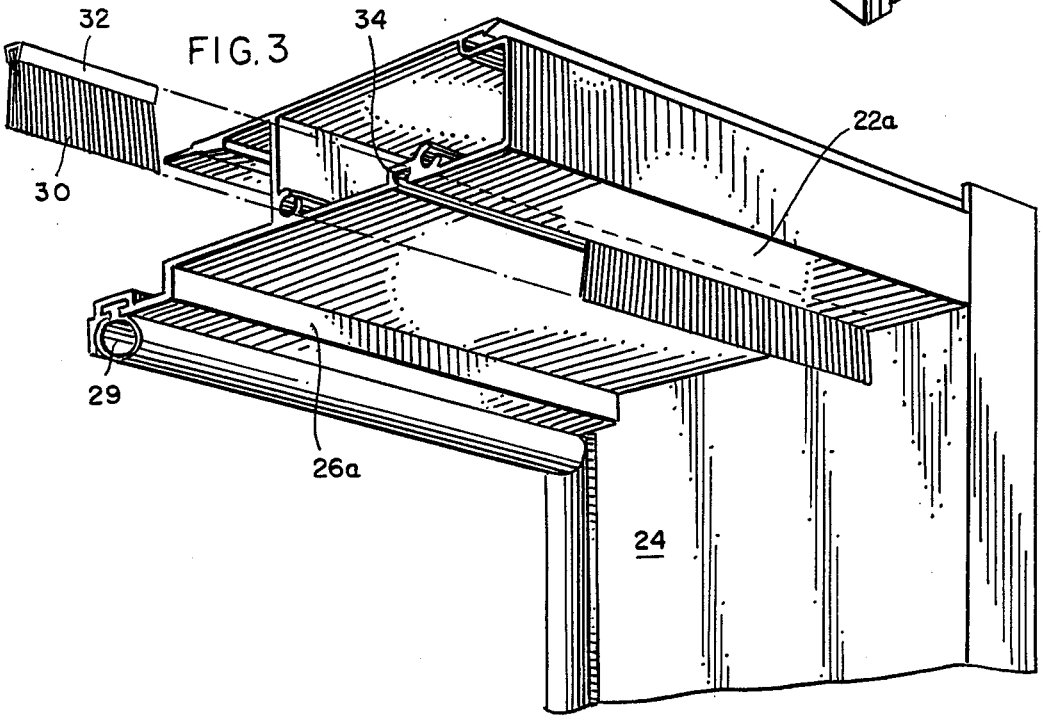
FIG. 3 is an enlarged, fragmentary perspective view, partly in cross-section, of the upper right-hand corner portion (see large encircled portion of FIG. 2) of the casement window frame shown in FIGS. 1 and 2.
Figure 4:
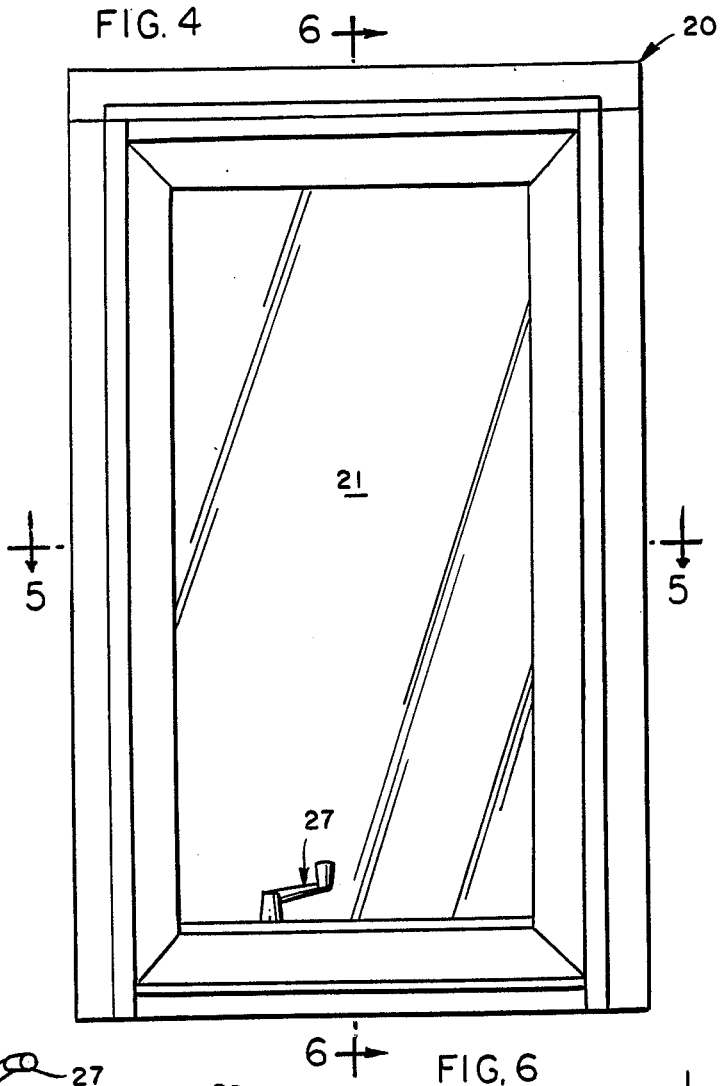
FIG. 4 is a front elevational view of a casement window and window frame incorporating the features of the present invention, as viewed from outside a building or other structure in which the window is installed, with the window shown in closed position.
Figure 5:
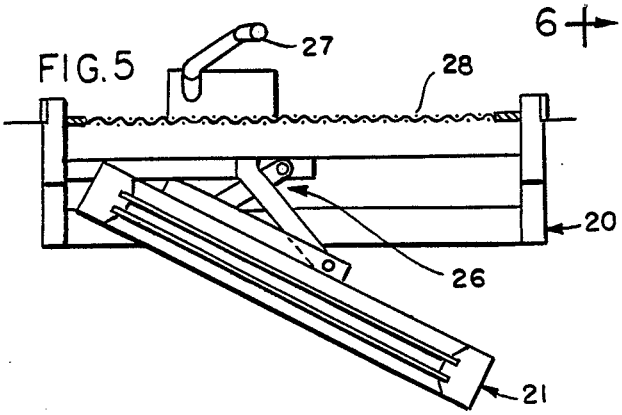
FIG. 5 is a transverse, cross-sectional view taken along the line 5—5 in FIG. 4.
Figure 6:
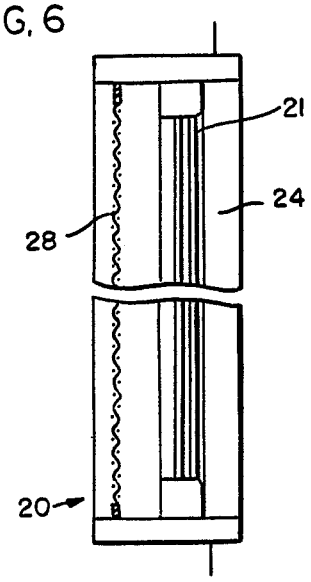
FIG. 6 is a vertical, cross-sectional view, partly broken, taken along the line 6—6 in FIG. 4.

Mounting of the row 30 of resilient fibers in the frame head jamb 22 is illustrated in FIG. 3. As shown there, a groove 34 is provided within the head jamb 22 of the frame and is aligned with the planar disposition of the window when closed. The backing strip 32 holding the fibers 30 is inserted lengthwise in the groove 34. Once inserted, the wedge shape of the backing strip 32 gives assurance that the strip will be held securely within the groove 34.

Figure 7:
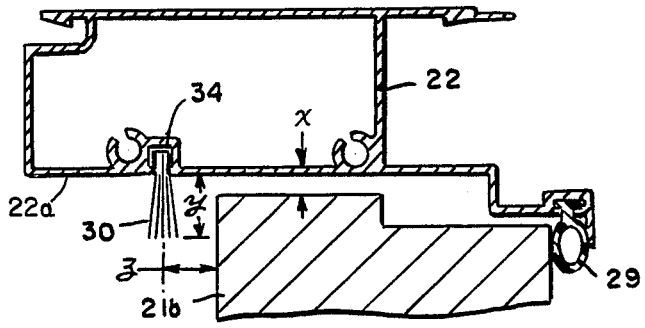
FIGS. 7 through 11 show several enlarged, fragmentary vertical cross-sectional views, "stop motion" in nature, taken through the upper portion of the illustrative casement window and frame, depicting the relationship between the top of the window and the frame during opening of the window (arrows designate direction of window movement in relation to frame).

As seen from FIG. 7, with the backing strip of the row 30 inserted in the groove 34, the row of resilient bristles extends downwardly a distance y from the head jamb surface 22*a*, corresponding to the length of the bristles exposed beneath the head jamb. In practice, the length y of the brush-like row 30 of bristles may be on the order of ⅜ to ½ inch, and the row has whatever length is necessary so that it is co-extensive with the width of the window to thereby cover the entire gap between the frame and the top of the window. It is essential that the distance y be greater than the space x so that the row 30 of fibers completely covers the gap or space between the top 21*a* of the window and the adjacent frame head jamb 22.

In accordance with one of the features of the invention, the fiber row 30 is mounted in the illustrative head jamb 22 so as to be horizontally spaced a distance z from the center line of the fibers to the front surface 21*b* of the window (FIG. 7). It is important that this distance z be about equal to or exceed the distance y so that the row 30 bristles will not become wedged in the space x when the window moves from an open to a closed position. Any such wedging or hanging up of the bristles in the gap x would prevent the bristles from resuming their normal position depending from the head jamb, and would thereby undesirably diminish the coverage of the gap by the bristles 30 when the window is closed.

Figure 8:
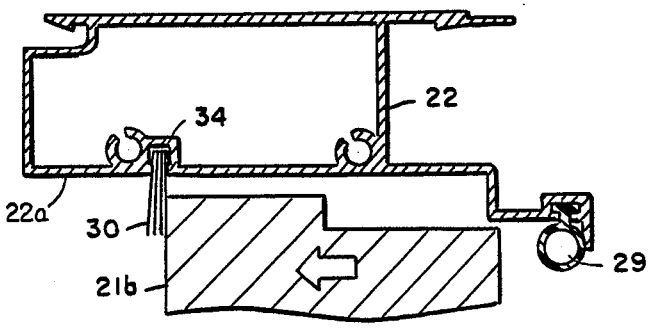
Figure 9:
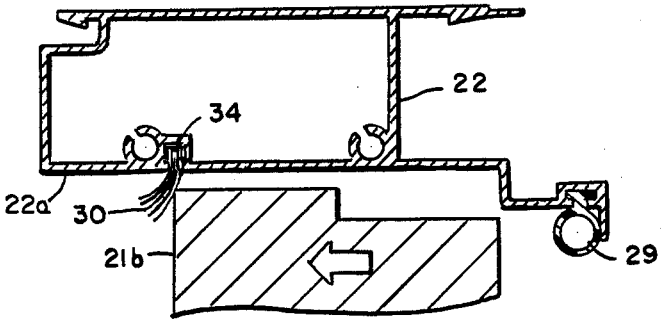
Figure 10:
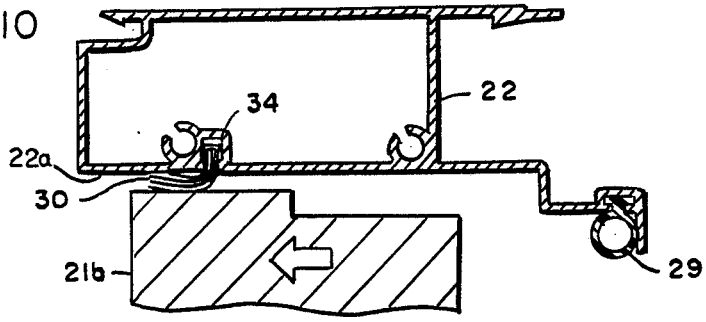
Figure 11:
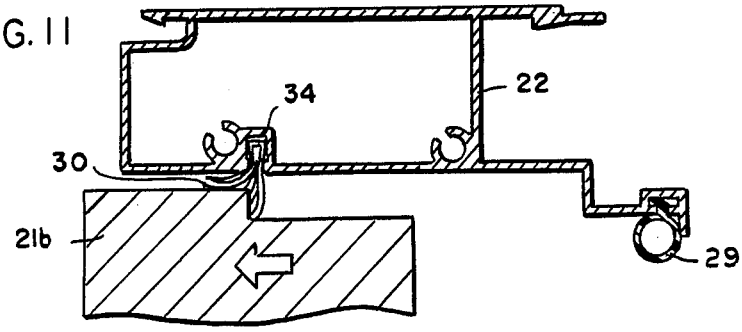

In FIGS. 7–11, several progressive steps are shown illustrating swinging motion of the window from a fully closed position (FIG. 7) to a partially open position (FIG. 11). In FIG. 7, the window is in fully closed position with the back of the window pressing against conventional tubular weatherstripping 29 to seal the window from leakage. FIG. 8 depicts the window slightly open, so that the tubular weatherstripping 29 seal is released, and just to the point where the front surface 21*b* of the window engages the row 30 of fibers. In the position of FIG. 9, the window has started to deform the fibers, and in FIG. 10 further deformation has taken place. As the window opens further, as shown in FIG. 11, it has moved to the point where the fibers have passed over the top of the window and are in partial engagement with the back surface of the window as they proceed to reassume their normal depending position. It will be observed that at all times during motion of the window the row 30 of resilient fibers completely covers or blocks the space x and protects it from entry of any rainwater, wind or the like.

Figure 16:
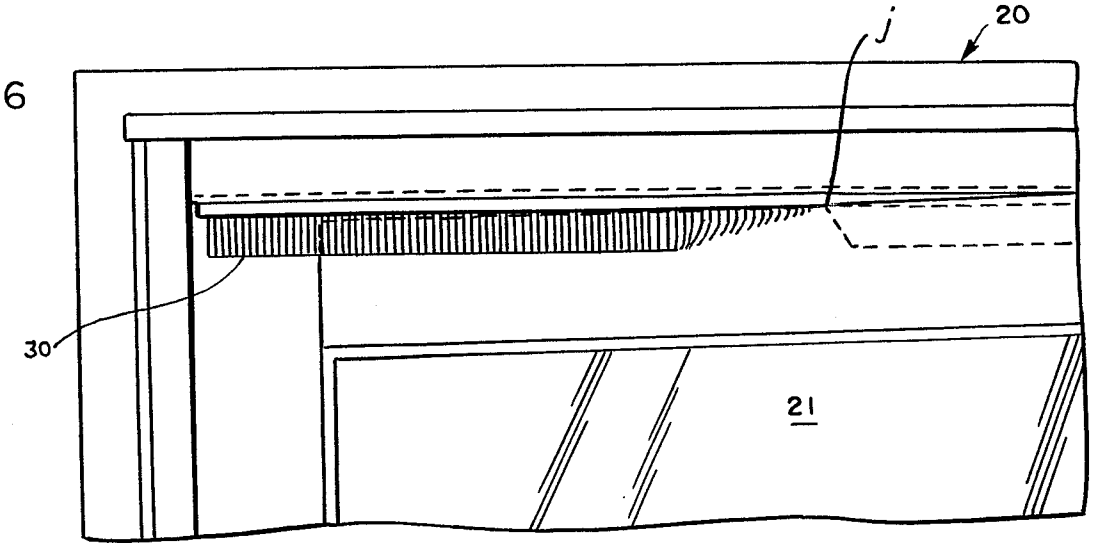
FIGS. 16 and 17 are enlarged, fragmentary, elevational views of the upper portion of an illustrative casement window and frame, showing the window partially open in two different positions, one about half-way open (FIG. 16) and one open a further distance (FIG. 17).
Figure 17:
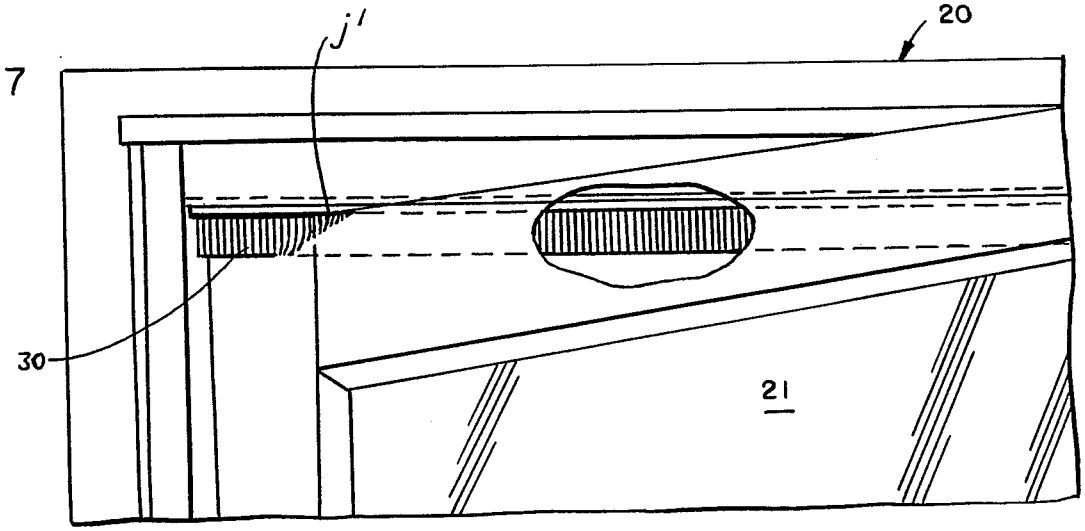

FIGS. 16 and 17 show other views of the appearance of the top of the window and frame as the window is being opened or closed. In FIG. 16, the window is open about half-way, with the point of juncture between the top of the window and the row 30 of fibers being shown at j. As the window is opened further, as shown in FIG. 17, the point of juncture j' moves from right to left (as viewed in the drawings) along the window. In FIG. 17, the point of juncture is just a short distance away from the hinged (left) side of the window. Importantly, at all times the row 30 of deformable resilient fibers completely covers the space x between the window and the frame to thereby seal this space from entry of the elements.

Figure 12:
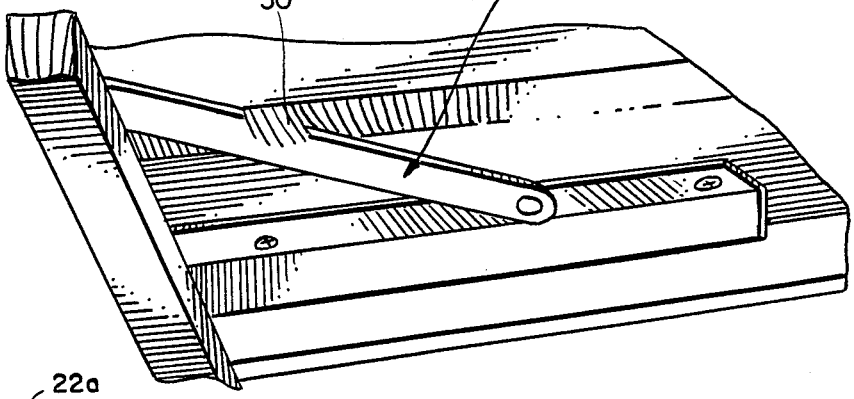
FIG. 12 is a fragmentary, perspective view, partly in section, looking upwardly at the relationship between the illustrative weatherstripping of the invention and the upper window hinge during opening or closing of the window (see small encircled portion FIG. 2).
Figure 13:
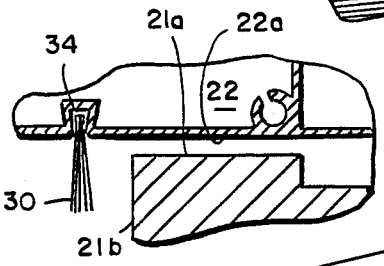
FIG. 13 is an enlarged, fragmentary, vertical, cross-sectional view, somewhat schematic in nature, taken through the upper portion of the window and the frame, similar to FIG. 7.
Figure 14:
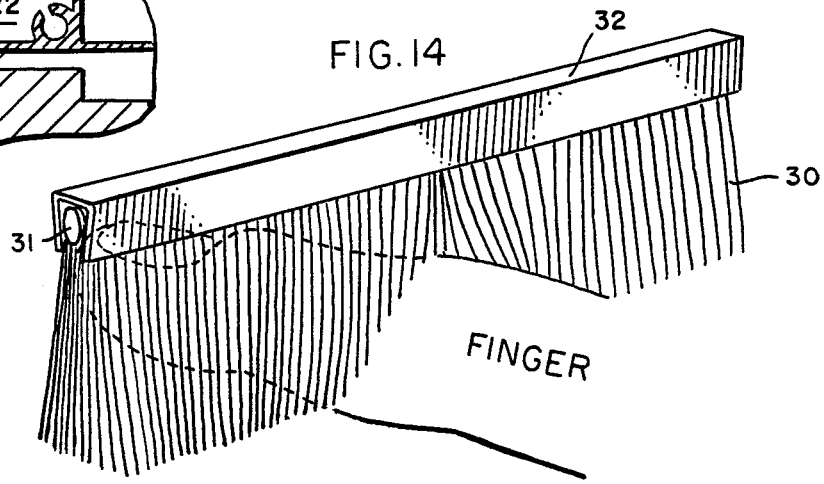
FIG. 14 is a fragmentary, perspective view of illustrative wearnerstripping which may be used in practicing the invention, depicting the weatherstripping in relation to a person's finger.

Other illustrations of the ready deformability of the row 30 of resilient fibers appear in FIGS. 12 and 14. In FIG. 12, the fiber row 30 is shown providing a continuous seal even as the upper window hinge 26 passes through it. In FIG. 14, an illustrative human finger is shown extending through the row 30 of resilient fibers demonstrating the manner in which the individual fiber strands deform as required to completely embrace the uneven contour of the finger, thereby sealing that contour so that passage of any rainwater or the like between such contour and the fibers would be impeded or prevented.

It is thus seen that the bristles 30 of the brush-like weatherstripping of the invention are capable of moving individually and incrementally to adapt to and thereby seal the angular closing or opening of the window against the frame. In other words, the bristles 30 collapse or become depressed in individual fashion as they are successively contacted by the top of the swinging window to thereby provide a continuous seal of the space between the window and the head jamb.

While the invention has been illustrated and described in terms of a casement window (that opens on hinges at the side), it will be readily understood that the invention applies equally well to side opening doors, covers or the like. In any or all of such structures, the weatherstripping of my invention provides a tight, secure barrier against entry of the elements along the top of the window or door, so that wind, rain, dirt, snow and the like cannot pass therethrough.

Certain preferred structures in accordance with the invention have been described and illustrated. It will be apparent to those skilled in the art that various changes and modifications may be made therein within the spirit and scope of the invention. It is intended that such changes and modifications be included within the scope of the appended claims.

I claim as my invention:

1. The combination comprising, a planar window or door, a planar frame for said window or door, said window or door being hinged at one side to said frame so that the window or door swings outwardly and inwardly in relation to the frame, the top of said window or door being spaced slightly beneath the adjacent portion of said frame to permit relative swinging movement between window and frame, a continuous row of resilient fibers mounted on said frame adjacent the top of said window or door and the adjacent portion of the frame of the window or door and the adjacent portion of the frame when the window is closed, said resilient row of fibers extending downwardly for said frame a distance greater than said space between the top of the window and the frame, said resilient row of fibers being horizontally spaced outwardly from said window when closed a distance about equal to or greater than the distance that said row of fibers extend downwardly form said frame, and said row of resilient fibers extending across the width of said window or door whereby as the window or door swings to open or closed positions the row of fibers deforms incrementally along the moving juncture between the top of the window or door and the frame to thereby provide a continuous seal against rainwater and wind leakage between the window or door top and the frame.

* * * * *